US005213539A

United States Patent [19]

Adler

[11] Patent Number: 5,213,539

[45] Date of Patent: May 25, 1993

[54] RETURNING FLYING RING TOY

[76] Inventor: Alan J. Adler, 752 La Para Ave., Palo Alto, Calif. 94306

[21] Appl. No.: 800,873

[22] Filed: Nov. 27, 1991

Related U.S. Application Data

[63] Continuation of Ser. No. 532,003, Jun. 1, 1990, abandoned, which is a continuation-in-part of Ser. No. 377,018, Jul. 6, 1989, abandoned.

[51] Int. Cl.[5] ..... A63H 27/00; A63B 65/08

[52] U.S. Cl. ..... 446/48; 446/66; 273/426

[58] Field of Search ..... 446/48, 47, 46, 36, 446/34, 66; 273/428, 427, 426, 425, 424

[56] References Cited

U.S. PATENT DOCUMENTS

| | | | |
|---|---|---|---|
| 2,324,022 | 7/1943 | Prause, Jr. | 446/48 X |
| 2,361,988 | 11/1944 | Bonnifield | 273/106 |
| 2,454,598 | 11/1948 | Doyle | 446/66 |
| 2,972,481 | 2/1961 | Shapiro | 273/426 |
| 3,264,777 | 8/1966 | McCreary, Jr. | 446/66 X |
| 3,403,910 | 10/1968 | Claycomb | 273/106 |
| 3,881,729 | 5/1975 | Block et al. | 446/36 X |
| 4,307,535 | 12/1981 | Martin | 446/48 |
| 4,479,655 | 10/1984 | Adler | 273/426 X |
| 4,506,894 | 3/1985 | Laux et al. | 273/426 X |
| 4,560,358 | 12/1985 | Adler | 446/46 |
| 4,591,164 | 5/1986 | Blight | 273/425 |
| 4,669,996 | 6/1987 | Bershak | 446/48 |

FOREIGN PATENT DOCUMENTS

| | | | |
|---|---|---|---|
| 289489 | 8/1966 | Australia | 273/426 |
| 1016170 | 9/1957 | Fed. Rep. of Germany | 446/36 |
| 3819951 | 1/1989 | Fed. Rep. of Germany | 273/426 |
| 9100757 | 1/1991 | PCT Int'l Appl. | 273/426 |

OTHER PUBLICATIONS

Frisbee Brand; Wham-O-Rang Instructions (1983).

Bluebird; Whizzback Instructions (1987).

Hartmann, Photograph of "Handmade triangular plywood boomerang".

Edward Edelson, *Popular Science*, "Lord of the Rings", Sep. 1986, pp. 94–95.

*Science Magazine*, "Ringing in a World Record", Spring 1985.

J. Anderson, "Introduction to Flight", McGraw-Hill Book Co., 1978, p. 154.

I. Abbott et al., "Theory of Wing Selections", Dover Pub., Inc. 1949, pp. 188–193.

R. Von Mises, "Theory of Flight", Dover Pub., Inc., 1945, pp. 156–157.

*Primary Examiner*—D. Neal Muir

*Attorney, Agent, or Firm*—Townsend and Townsend

[57] ABSTRACT

A returning flying ring toy (10) of modified triangular-ring planform and an improved airfoil comprising an abrupt transition (49) on the upper surface (15–46,48), near the trailing edge (33).

11 Claims, 3 Drawing Sheets

RETURNING FLYING RING TOY

This is a continuation application of 07/532,003, filed Jun. 1, 1990 which is a C-I-P of Ser. No. 07/377,018, filed Jul. 6, 1989, both abandoned.

BACKGROUND OF THE INVENTION

The present invention relates to flying toys which can be thrown and will return to the thrower. The earliest known returning flying toys are boomerangs. It is believed by historians that boomerangs have been used for at least four thousand years. These devices are generally wooden sticks of arc-shaped planform. They are hazardous and require a strong and skilled thrower.

SUMMARY OF THE INVENTION

The present invention is a returning flying toy. Its flight pattern is comparable to a boomerang but it is easier to throw and catch. It is lighter in weight and safer than any known prior art returning flying toy of comparable flight distance.

The toy comprises a body in the form of a substantially triangular ring characterized by an inner perimeter and an outer perimeter. The inner perimeter is substantially triangular with rounded corners. The outer perimeter is substantially triangular but is widened at its three corners to define three wingtip areas, at least two of which are formed to provide lift.

The preferred embodiment of the invention employs a novel airfoil section for the wingtip areas which provides improved aerodynamic performance. The airfoil is defined by the wingtip area being formed with a downwardly depending flap at its trailing edge. The airfoil cross-section is characterized by an abrupt downward transition on the upper surface where the flap joins the main portion of the airfoil. The abrupt transition encourages separation of the airflow near the trailing edge of the upper surface of the wingtip area as the body spins and is well suited to molded plastic or molded rubber manufacture.

A further understanding of the nature and advantages of the present invention may be realized by reference to the remaining portions of the specification and the attached drawings.

DESCRIPTION OF SPECIFIC EMBODIMENTS

Figure 1:
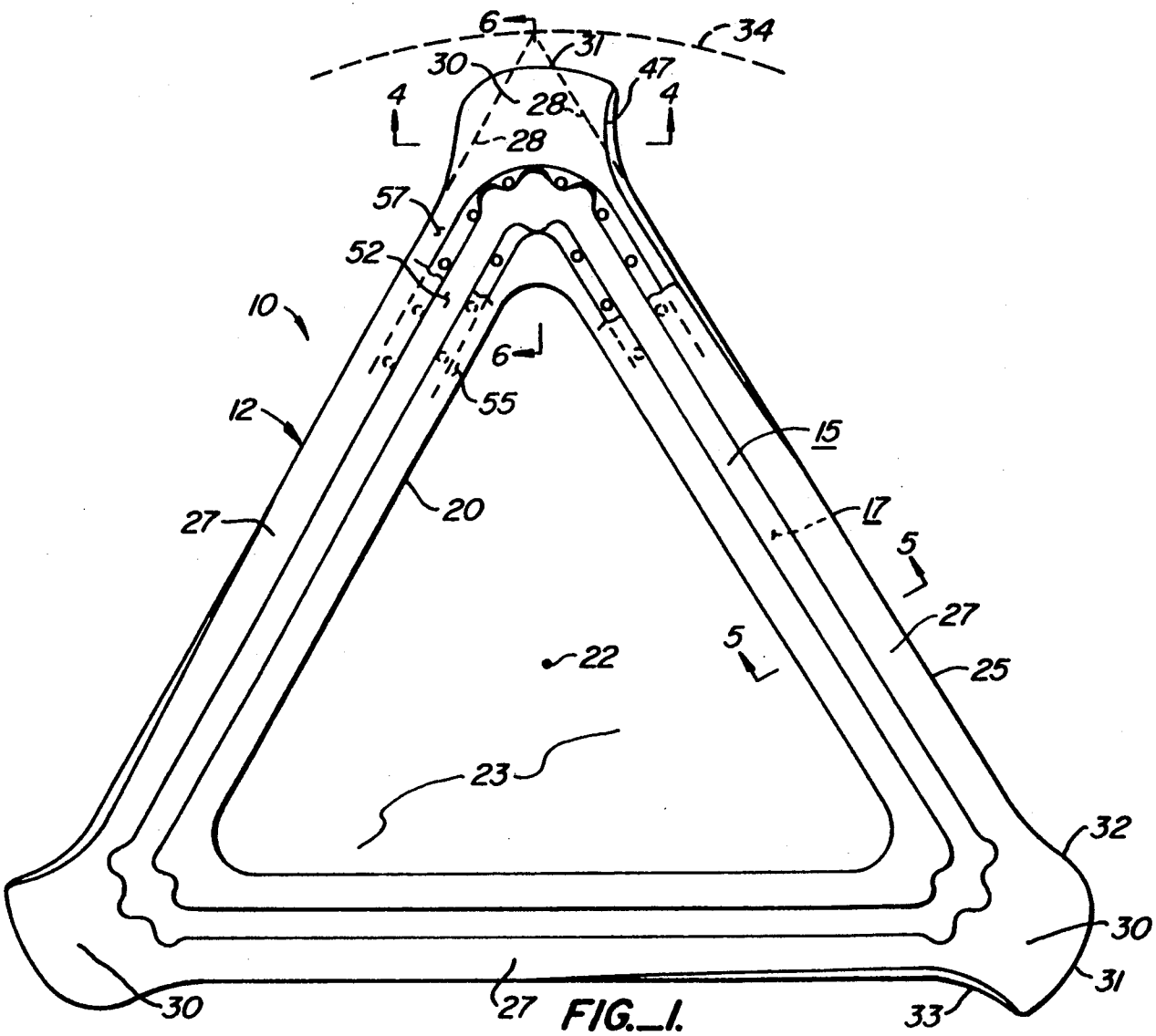
FIG. 1 is a plan view of a preferred embodiment of a flying ring toy according to the present invention.

FIG. 1 is a plan view of a flying ring toy 10 according to the invention. Toy 10 comprises a thin aerodynamic body 12 of substantially triangular-ring planform with an upper surface 15 and a lower surface 17. The substantially triangular-ring planform is characterized by an inner perimeter 20 of substantially triangular shape with rounded corners, encompassing a center point 22 and central opening 23. The inner perimeter is encompassed by an outer perimeter 25 of substantially triangular shape (except near the corners) to define three sides 27 of body 12.

The triangular outer perimeter is widened in the area of the three corners by laterally broadening the perimeter outward from the normal extensions 28 (shown in phantom) of the outer perimeter lines defining the triangular sides and rounded at the three corners to define three wingtip areas 30, each having a radially outermost extremity 31, a leading edge 32, and a trailing edge 33. At least two of the wingtip areas 30 are formed with leading edge 32 higher than trailing edge 33 so as to produce aerodynamic lift at the wingtips areas as body 12 spins about an axis which is perpendicular to the plane of the body and passes through center point 22. References to the leading and trailing edges are with respect to such spin.

The lateral broadening beyond extensions 28 of the straight segments of the outer perimeter is relatively small so that each wingtip area has a relatively small area outside the longitudinal extensions. If a circle (a portion 34 of which is shown in phantom) is drawn through the three intersection points of the extensions, the entire outer perimeter lies within the circle.

Figure 2A:
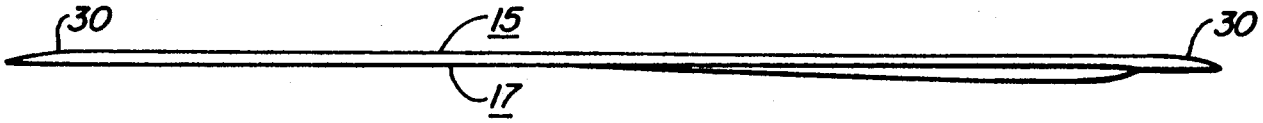
FIGS. 2A and 2B are edge views of two variants of the toy.
Figure 2B:
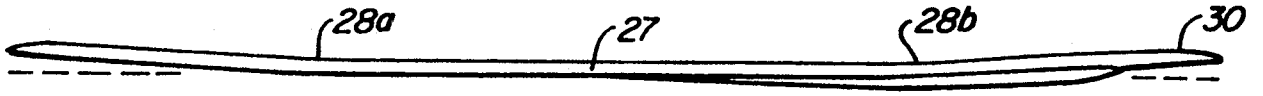

FIGS. 2A and 2B are edge views of two variants of toy 10. As can be seen in both figures, body 12 extends generally in a plane.

FIG. 2A is an edge view of the basic form of toy 10. In this basic form, wingtips 30 are substantially in the same plane as the main body 12. FIG. 2B is an edge view of the preferred embodiment of toy 10. In this preferred embodiment, wingtips 30 are bent slightly upwards above the plane of the central parts of body sides 27. This upward bend elevates the toy's flight path and makes it easier to catch upon return. The upward bend can take the form of a gentle bow curve distributed over the length of one or more of sides 27. Alternatively, the bend can be concentrated at two locations **28*a* and 28*b* along one or more sides of the triangular-ring as shown in FIG. 2B**.

Figure 3:
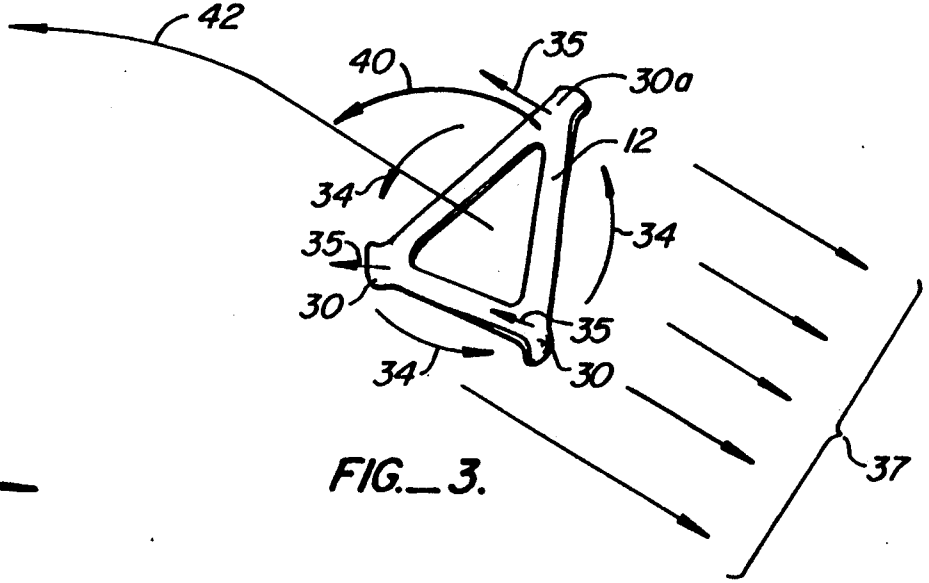
FIG. 3 illustrates the forces on the toy in flight.

FIG. 3 shows the forces that are generated when the toy is thrown forward with spin (as depicted by arrows 34) wingtip areas 30 produce aerodynamic lift (shown by arrows 35) in a direction perpendicular to the plane of body 12. A specific wingtip area, designated **30*a* (which at the instant is at the top of the spin cycle) is spinning into the flow of air 37. Consequently, (because lift is proportional to the square of the air velocity) wingtip area 30*a* develops greater lift than the other two wingtip areas. This greater aerodynamic lift of the top wingtip area will produce a rolling moment 40. Gyroscopic precession converts rolling moment 40 into a yawing moment 42** and causes the body to fly in a substantially circular path and return to the thrower.

Figure 4A:
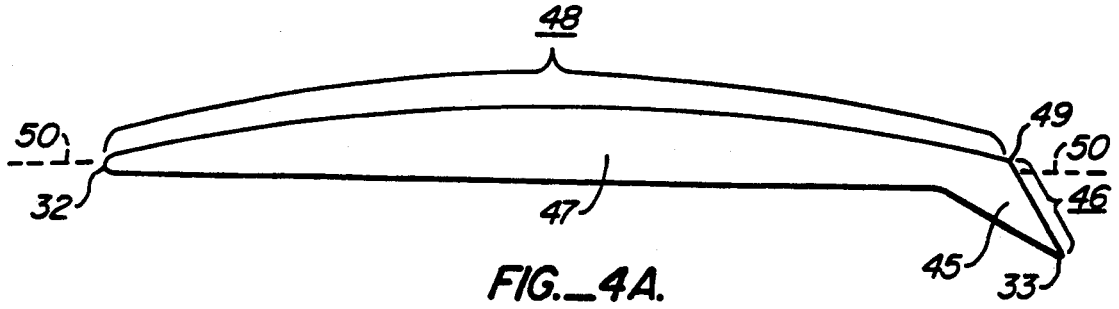
FIG. 4A is a cross-section, taken at line 4—4 in FIG. 1, illustrating the preferred embodiment of the toy and the improved airfoil.

FIG. 4A is a section taken at line 4—4 in FIG. 1, and illustrates the preferred method of forming wingtip areas 30 to produce aerodynamic lift as the body spins. A trailing portion of the wingtip area is configured with a depending fixed flap 45 having an upper surface segment 46. The portion 47 exclusive of the flap is referred to as the main portion and has an upper surface segment 48. The flap is formed to define an abrupt downward transition 49 in the upper surface of the wingtip area between upper surface segments 46 and 48. Transition 49 is the lowest point on the trailing half of upper surface segment 48.

In this context, an abrupt transition is defined as a change in angle of the contour of the surface when viewed in cross-section, wherein the change of angle is accomplished relatively sharply. In the preferred embodiment of the invention the change of the angle is approximately 50°, however, it is believed that any change of angle greater than approximately 20° will achieve the desired flow separation. The abrupt transition 49 is so formed to encourage separation of the airflow over the upper surfaces 15 of the wingtip areas at the abrupt downward transition as the body spins about its center point.

Figure 4B:
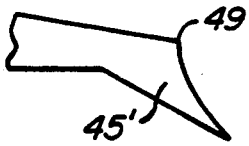
FIG. 4B is a fragmented cross-section showing a variant on the embodiment of FIG. 4A.

Upper surface segment 48 is non-concave (typically convex or flat over all of its area) as part of an effort to further assist delaying flow separation until the flow reaches the abrupt transition. Upper surface segment 46 is flat. However, FIG. 4B shows a variant where the flap, designated 45', has a concave upper surface.

The present inventor has discovered that, with small scale flying objects, the airfoil of FIG. 4A has less drag for a given amount of lift than conventional airfoils. It is believed that flow separation in this airfoil is delayed until the flow reaches abrupt transition 49 near the trailing edge of the airfoil, as opposed to the more common laminar separation which occurs near the leading edge of small scale airfoils. It is anticipated that this improved airfoil will be found advantageous when applied to other flying toys, such as flying rings, boomerangs, propellers, and toy or model airplanes.

A further benefit of the improved airfoil depicted in FIG. 4A is that it can be manufactured in a mold having a planar parting line 50, as opposed to twisted wings (such as that of FIG. 7) which require that the mold have a non-planar parting line in order to meet the leading and trailing edges. Molds with planar parting lines can be made with greater precision and lower cost than molds with non-planar parting lines.

Figure 5:
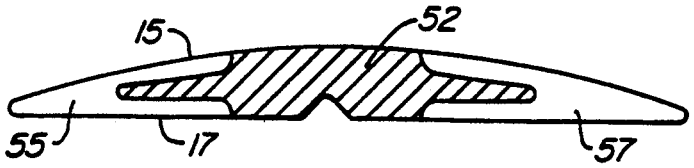
FIG. 5 is a cross-section, taken at line 5—5 in FIG. 1, illustrating the preferred composite construction of the toy.
Figure 6:
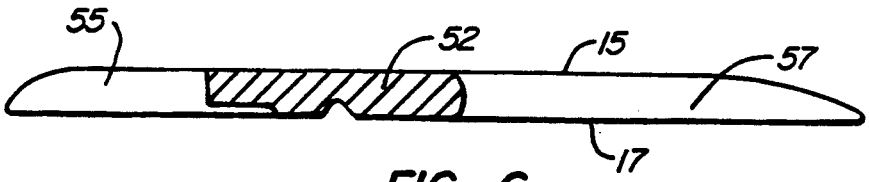
FIG. 6 is a cross-section taken at line 6—6 in FIG. 1, further illustrating the preferred composite construction of the toy.

FIGS. 1, 5, and 6 also illustrate another feature of the preferred embodiment of the invention. The body is molded of two different materials. First an inner triangular ring backbone 52 is molded from a relatively rigid, yet springy, thermoplastic material such as polycarbonate. Backbone 52 is then inserted into a second mold and the inner and outer perimeter portions 55 and 57 comprised of a soft resilient material (such as thermoplastic rubber), are molded over the backbone. The resulting composite body is safer than if made from a single material.

In the preferred embodiment of the planform of body 12, the outer perimeter 25 is widened at the wingtip areas so as to increase the area of the wingtip areas such that the aerodynamic rolling moment (produced by their aerodynamic lift) and the resulting yawing moment will be enhanced. The widened wingtip areas have a crescent-shaped planform with a convex leading edge and a concave trailing edge. The trailing edges 33 of the crescent-shaped wingtip areas provides a convenient place to apply pressure with the tip of the forefinger while throwing and thus impart spin to the body. It is noted that some recent articles in the aerodynamic literature have suggested that crescent-shaped wingtips have slightly lower induced drag than other tip planforms. However, the primary reason for the use of crescent-shaped wingtip areas on the present invention is to facilitate throwing with spin.

In the preferred embodiment of the invention the thickness of the modified triangular-ring body 12 is 0.125 inches and the chord of the modified triangular-ring, as measured at the side of the modified triangle from the inner perimeter to the outer perimeter, is 1.125 inches. As noted above, the wingtip has a relatively small area outside longitudinal extensions 28. As can be seen in FIG. 1, each wingtip extends beyond the extension by a distance less than the chord of the modified triangular ring. The chord of each wingtip area 30 is about 1.7 inches. However as can be seen in FIG. 1, the chord is not constant and diminishes to zero at the extremity of the wingtip. The radius from the center 22 to extremity 31 of the wingtips is 6.375 inches. Lower surface 17 is substantially flat except in the region of the downwardly depending flaps 45. As noted above, upper surface 15 is preferably convex except in the region of the flaps. The total weight is approximately two ounces, yet the returning flying ring can fly a circular path approximately 100 feet in diameter and return to the thrower. Central opening 23 provides an easy means of catching the returning flying ring upon return.

As mentioned above, wingtip areas 30 are formed with the leading edge higher than the trailing edge, referenced to the plane of the body. The wingtip profile with the flap, as described above, represents one such approach.

Figure 7:
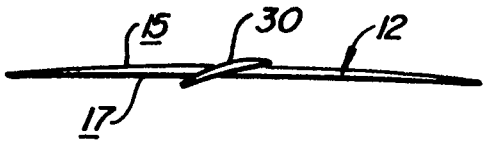
FIG. 7 is an edge view of an alternative embodiment.

An alternative method of forming wingtip areas 30 so that they produce aerodynamic lift as the body spins is to twist them in the manner of a propeller, as depicted in FIG. 7, which is an edge view of the device.

While in the foregoing specification embodiments of the invention have been set forth in detail for purposes of making a thorough disclosure of the invention, it will be apparent to those skilled in the art that numerous changes can be made in such details without departing from the spirit of the invention.

What is claimed is:

1. A returning flying ring formed as a thin aerodynamic body extending generally in a plane, the body having an upper surface and a lower surface, the body being characterized by:

an inner perimeter of substantially triangular shape with rounded corners, encompassing a center point and a center opening;

an outer perimeter having three non-intersecting, straight segments, each straight segment having longitudinal extensions, wherein said straight segments and their longitudinal extensions define a triangle having three corners;

the body having a chord dimension defined as the shortest distance between said inner perimeter and said outer perimeter;

said outer perimeter departing from precise triangularity in three corner regions, being widened and rounded in said three corner regions to define three wingtip areas, each of said wingtip areas extending outside the longitudinal extensions of said straight segment by a distance that is less than said chord dimension;

each of said wingtip areas having a leading edge and a trailing edge; and at least two of said wingtip areas being formed with said leading edge higher than said trailing edge relative to the plane of the body so as to produce aerodynamic lift at said wingtip areas as the body spins about an axis which is perpendicular to the plane of the body and passes through said center point;

such that when the returning flying ring is thrown forward with spin, said aerodynamic lift of said wingtip areas will produce a rolling moment and cause the returning flying ring to fly in a substantially circular path.

2. The returning flying ring of claim 1 wherein said outer perimeter is formed such that said wingtip areas are crescent-shaped.

3. The returning flying ring of claim 1 wherein at least two of said wingtip areas are twisted, in the manner of a propeller, so as to produce said aerodynamic lift at said wingtip areas.

4. The returning flying ring of claim 1 wherein at least one of said wingtip areas is formed with a main portion and with an adjoining downwardly depending fixed flap at a trailing portion of said wingtip area in order to produce said aerodynamic lift at said wingtip area.

5. The returning flying ring of claim 1 wherein portions of the body bounding said inner and outer perimeters are formed of a soft resilient material so as to enhance the safety of said returning flying ring.

6. The returning flying ring of claim 4 wherein at least one of said wingtip areas has an upper surface and is shaped with a cross-section characterized by an abrupt downward transition at a location on said upper surface where said main portion of said wingtip area and said downwardly depending flap join so as to encourage separation of the airflow over said upper surface of said wingtip area at said abrupt downward transition.

7. The returning flying ring of claim 6 wherein said abrupt downward transition extends on the upper surface of the body outside of said wingtip area and meets one of said straight segments near a midpoint thereof.

8. A returning flying ring having a thin aerodynamic body extending generally in a plane, the body having an upper surface, the body being characterized by:

an inner perimeter of substantially triangular shape with rounded corners, encompassing a center point and central opening;

an outer perimeter having three non-intersecting straight segments, each straight segment having longitudinal extensions, wherein said straight segments and their longitudinal extensions define a triangle having three corners;

the body having a chord dimension defined as the shortest distance between said inner perimeter and said outer perimeter;

said outer perimeter departing from precise triangularity in three corner regions, being widened and rounded at the three corners to define three wingtip areas, each of said wingtip areas extending outside the longitudinal extensions of said straight segments by a distance that is less than said chord dimension;

each of said wingtip areas having a leading edge and a trailing edge; and each of at least two of said wingtip areas having an upper surface and being formed with a main portion and an adjoining downwardly depending fixed flap, said flap having a trailing edge that defines said trailing edge of said wingtip area and is lower than said leading edge relative to the plane of the body, said main portion and said flap having respective upper surfaces with an abrupt downward transition between said upper surface of said main portion of said wingtip area and said upper surface of said flap so as to encourage separation of airflow over said upper surfaces of said wingtip areas at said abrupt transition, and further to produce aerodynamic lift at said wingtip areas as the body spins about an axis which is perpendicular to the plane of the body and passes through said center point;

such that when the returning flying ring is thrown forward with spin, said aerodynamic lift of said wingtip areas will produce a rolling moment which gyroscopic precession will convert into a yawing moment and cause the returning flying ring to fly in a substantially circular path.

9. The returning flying ring of claim 8 wherein the body comprises:

an inner triangular-ring backbone molded from a relatively rigid, yet springy, thermoplastic material being in the form of a triangular ring with rounded corners; and inner and outer perimeter portions formed from a soft resilient material, molded over said backbone to define said inner and outer perimeters and said wingtip areas.

10. A returning flying ring having a thin aerodynamic body extending generally in a plane, the body having an upper surface, the body being characterized by:

an inner perimeter of substantially triangular shape with rounded corners defining a central opening and encompassing a center point;

an outer perimeter having three non-intersecting straight segments, each straight segment having longitudinal extensions, wherein said straight segments and their longitudinal extensions define a triangle having three corners;

said outer perimeter lying entirely within a constructed circle passing through said three corners, and being widened and rounded in the regions near said three corners to define three wingtip areas; and each of said wingtip areas having a leading edge and a trailing edge;

at least two of said wingtip areas being formed with said leading edge higher than said trailing edge relative to the plane of the body to produce aerodynamic lift at said wingtip areas as the body spins about an axis which is perpendicular to the plane of the body and passes through said center point;

such that when the returning flying ring is thrown forward with spin, said aerodynamic lift of said wingtip areas will produce a rolling moment which gyroscopic precession will convert into a yawing moment and cause the returning flying ring to fly in a substantially circular path.

11. The returning flying ring of claim 8 wherein said abrupt downward transition extends on the upper surface of the body outside of said wingtip area and meets one of said straight segments near a midpoint thereof.

* * * * *